US007743444B2

(12) United States Patent
Murakoshi et al.

(10) Patent No.: US 7,743,444 B2
(45) Date of Patent: Jun. 29, 2010

(54) CABLE STAYED SUSPENSION BRIDGE MAKING COMBINED USE OF ONE-BOX AND TWO-BOX GIRDERS

(75) Inventors: Jun Murakoshi, Tsukuba (JP); Koichiro Fumoto, Tsukuba (JP); Hideki Shimodoi, Hyogo (JP); Masao Miyazaki, Tokyo (JP); Syuji Shirai, Osaka (JP); Masato Suzawa, Tokyo (JP)

(73) Assignees: Incorporated Administrative Agency Public Works Research Institute, Ibaraki (JP); Honshu-Shikoku Bridge Expressway Company Limited, Hyogo (JP); Incorporated Foundation Public Works Research Center, Tokyo (JP); Kawasaki Jukogyo Kabushiki Kaisha, Hyogo (JP); Kawada Industries, Inc., Tokyo (JP); Sumitomo Heavy Industries, Ltd., Tokyo (JP); Hitachi Zosen Corporation, Osaka (JP); Ishikawajima-Harima Heavy Industries Co., Ltd., Tokyo (JP); JFE Engineering Corporation, Tokyo (JP); Mitsui Engineering & Shipbuilding Co., Ltd., Tokyo (JP); Mitsubishi Heavy Industries, Ltd., Tokyo (JP)

( * ) Notice: Subject to any disclaimer, the term of this patent is extended or adjusted under 35 U.S.C. 154(b) by 633 days.

(21) Appl. No.: 11/570,317

(22) PCT Filed: Jun. 9, 2004

(86) PCT No.: PCT/JP2004/008032

§ 371 (c)(1),
(2), (4) Date: May 15, 2007

(87) PCT Pub. No.: WO2005/121456

PCT Pub. Date: Dec. 22, 2005

(65) Prior Publication Data

US 2008/0313825 A1 Dec. 25, 2008

(51) Int. Cl.
*E01D 11/00* (2006.01)

(52) U.S. Cl. ..... 14/18

(58) Field of Classification Search ..... 14/18, 14/19, 20, 74.5
See application file for complete search history.

(56) References Cited

U.S. PATENT DOCUMENTS 3,132,363 A * 5/1964 Roberts ..... 14/18

(Continued)

FOREIGN PATENT DOCUMENTS

JP 9-143921 * 6/1997

(Continued)

OTHER PUBLICATIONS

Yoshimura, et al., "Static Characteristics of Cable Stayed Suspension Bridge", 45th Conference, I-280, p. 590-591, Sep. 1990.

(Continued)

*Primary Examiner*—Gary S Hartmann
(74) *Attorney, Agent, or Firm*—Knobbe, Martens, Olson & Bear, LLP

(57) ABSTRACT

A cable-stayed suspension bridge having characteristics of a cable stayed bridge and those of a suspension bridge at the same and time and using one-box and two-box girders in combination is disclosed. The bridge grinder of the cable-stayed suspension bridge includes one-box girders that each extend to both sides through the respective one tower and a two-box girder set in a central portion of the center span between towers in the length direction of the bridge girder. The cable-stayed suspension bridge includes cable-stayed structures in which a respective one of the one-box girders is supported by the tower with plural cables and a suspension structure in which the two-box girder is supported by the plural towers with two main cables and plural hanger ropes. The two-box girder has a central ventilation opening in the central portion as viewed in a transverse direction thereof. The hanger ropes in the suspension structure extend from the main cables almost perpendicularly, and their lower end portions are connected to the end portions in the transverse direction of the central ventilation opening or in the vicinity thereof.

4 Claims, 11 Drawing Sheets

U.S. PATENT DOCUMENTS

| | | | | | |
|---|---|---|---|---|---|
| 3,673,624 | A | * | 7/1972 | Finsterwalder et al. | 14/19 |
| 4,513,465 | A | * | 4/1985 | Schambeck | 14/74.5 |
| 4,665,578 | A | * | 5/1987 | Kawada et al. | 14/74.5 |
| 4,777,686 | A | * | 10/1988 | Muller | 14/77.1 |
| 5,539,946 | A | * | 7/1996 | Kawada | 14/18 |
| 5,784,739 | A | * | 7/1998 | Kawada et al. | 14/18 |
| 5,850,652 | A | * | 12/1998 | Yamamura et al. | 14/18 |

FOREIGN PATENT DOCUMENTS

| | | | |
|---|---|---|---|
| JP | 2002-266315 | A | 9/2002 |
| JP | 2004-36271 | A | 2/2004 |
| WO | WO 9316232 | * | 8/1993 |
| WO | WO 94/10386 | * | 5/1994 |

OTHER PUBLICATIONS

Matsuda, et al., "Examination of Static Characteristics of Cable Stayed Suspension Bridge", 45th Conference, I-281, p. 592-593, Sep. 1990.

Nomura, et al. "Trial Design of a Span 900 m cable Stayed Suspension Bridge", 48th Conference, I-431, p. 1010-1011, Sep. 1993.

Nomura, et al., Structural Characteristic and Economy of Cable Supported Bridges With Long Span, Structural Engineering Reports vol. 41A, p. 1003-1014, Mar. 1995.

Murakoshi, et al., "Study of Upper Structure in Super Long Bridge with Excellent in Economy and Wind Resistance", 58th Conference, I-108, p. 215-216, Sep. 2003.

Roku, et al., "Examination Related to the Wind Resistant Stability of a Two-box Girder Cross Section", 57th Conference, I-488, p. 975-976, Sep. 2002.

* cited by examiner

FIG.5

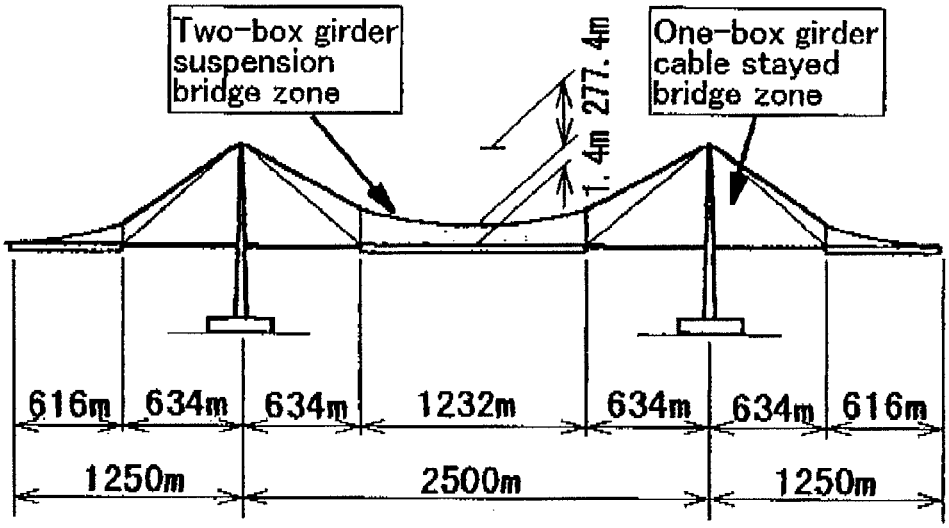

FIG.6

Various Dimensions of Cable-stayed suspension bridge

| | Suspension bridge (Conventional) | Cable-stayed suspension bridge |
|---|---|---|
| One-box girder | | |
| Sectional area | 1.289 $m^2$ | 1.776 $m^2$ |
| Perpendicular bending rigidity | 9.524 $m^4$ | 13.278 $m^4$ |
| Horizontal bending rigidity | 133.333 $m^4$ | 183.200 $m^4$ |
| Torsional rigidity | 19.753 $m^4$ | 31.000 $m^4$ |
| Weight | 35.690 tf/m | 38.210 tf/m |
| Polar moment of inertia | 2795 tf-$m^2$/m | 3218 tf-$m^2$/m |
| Two-box girder | | |
| Sectional area | 1.516 $m^2$ | 1.516 $m^2$ |
| Perpendicular bending rigidity | 9.660 $m^4$ | 9.660 $m^4$ |
| Horizontal bending rigidity | 263.326 $m^4$ | 263.300 $m^4$ |
| Torsional rigidity | 20.979 $m^4$ | 20.979 $m^4$ |
| Weight | 40.120 tf/m | 36.820 tf/m |
| Polar moment of inertia | 5100 tf-$m^2$/m | 5100 tf-$m^2$/m |
| Main cable | | |
| Sectional area | 0.685 $m^2$ | 0.475 $m^2$ |

FIG.10

Vibration characteristics (Primary vibration modes) of cable-stayed suspension bridge

| | ①Suspension bridge (Comparative Example) | ②Cable-stayed suspension bridge | ②/① |
|---|---|---|---|
| Perpendicularly bending symmetry (1st) | | | |
| Order of vibration mode | 2nd | 2nd | — |
| Specific frequency | 0.053 Hz | 0.053 Hz | 0.993 |
| Equivalent mass | 4.004 $tf \cdot s^2/m^2$ | 3.802 $tf \cdot s^2/m^2$ | 0.950 |
| Horizontally bending symmetry (2nd) | | | |
| Order of vibration mode | 8th | 8th | — |
| Specific frequency | 0.101 Hz | 0.109 Hz | 1.079 |
| Equivalent polar moment of inertia | 26088 $tf \cdot s^2$ | 37207 $tf \cdot s^2$ | 1.426 |
| Torsional symmetry (1st) | | | |
| Order of vibration mode | 18th | | |
| Specific frequency | 0.148 Hz | | |
| Equivalent polar moment of inertia | 5904 $tf \cdot s^2$ | | |
| Order of vibration mode | 25th | 22nd | — |
| Specific frequency | 0.188 Hz | 0.184 Hz | 0.979 |
| Equivalent polar moment of inertia | 947 $tf \cdot s^2$ | 552 $tf \cdot s^2$ | 0.583 |

CABLE STAYED SUSPENSION BRIDGE MAKING COMBINED USE OF ONE-BOX AND TWO-BOX GIRDERS

This application is the U.S. National Phase under 35 U.S.C. §371 of International Application PCT/JP2004/008032, filed Jun. 9, 2004. The International Application was not published under PCT Article 21(2) in English.

TECHNICAL FIELD

The present invention relates to a cable-stayed suspension bridge using one-box and two-box girders in combination, which bridge is suitable as a long and large suspension bridge. In particular, the present invention relates to a cable-stayed suspension bridge using one-box and two-box girders in combination, wherein one-box and two-box girders are employed as a bridge girder, and the one-box girders being set in the cable-stayed bridge area and two-box girders set in the suspension bridge region.

BACKGROUND ART

Recently, the cable-stayed bridges and the suspension bridges have become longer and larger. The cable-stayed bridges are advantageous in that they have high torsional rigidity of the bridge girder and excellent wind resistance performance against the crosswind. In addition, the cable-stayed bridge has a simple structure, and is advantageous in the cost of the construction. However, the length of the center span is about 1000 m at most in the cable-stayed bridges practically used. When the length of the center span of the cable-stayed bridge is large, the height of the tower in the cable-stayed bridge increases. Thus, the weight and the load to be supported by the tower increases, so that the size of the tower is enlarged. The load acting on the bridge girder in the bridge axial direction increases, too. Consequently, the structural advantageousness that the foundation structure of the tower becomes larger decreases.

Then, suspension bridges are usually adopted as long bridges where the center span is 1000 m or more. However, the height of the tower is also large in the suspension bridge, so that the foundation structure of the tower becomes larger. The cost of the construction of long and large main cables becomes high. Further, it is not easy to secure the wind resistance performance to the crosswind.

In case of cable-stayed bridges having large lengths of the center spans among conventional cable-stayed bridges, flat type one-box girder is often adopted as their bridge girders. In the conventional long suspension bridge, the above one-box girders are adopted as the bridge girders in some cases, while two-box girders having open space in the transverse direction for air ventilation are adopted in other cases.

Under the circumstances, in order to utilize the features of the cable-stayed bridge and those of the suspension bridge, there has been proposed the mixed structure named the cable-stayed suspension bridge in which the cable-stayed bridge and the suspension bridge are combined together. For example, two articles (Article Nos. 1 and 2) of "Static characteristics of the cable-stayed suspension bridge" (I-280) and "Examination of static properties of the cable-stayed bridge utilizing the suspension bridge in combination" (I-281) were published in the collected papers of the 45th Annual Science Lecture Meeting of Civil Engineering Association in Japan (September, 1990).

Further, an article (Article No. 3): "Trial designing of 900 m-span cable-stayed suspension bridge" was published in the collected papers of the 48th Annual Science Lecture Meeting of Civil Engineering Association in Japan (September, 1993). Furthermore, an article (Article No. 4): "Structural characteristics and economy of the long suspension type bridges" was published in Structural engineering collected papers (Vol. 41A) in Japan (March, 1995). Those articles examined the structure, the weight of the steel material, the rigidity, the wind resistance stability, and the economy with respect to cable-stayed suspension bridges having longer center spans, in which two main cables are stretched over plural towers and anchorage structures on opposite banks in a cable-stayed bridge having a long center span, while a suspension structure is adopted to suspend a central portion of the center span with the main cables and hanger ropes.

The structure mainly composed of the cable-stayed bridges are adopted in the cable-stayed suspension bridges described in these Article Nos. 1 to 4. For instance, in the cable-stayed suspension bridge of Article No. 3, the length of the center span is 1500 m, the length of the cable-stayed structure extending on the sides of the tower is 550 m, and the length of the suspension structure of the central portion in the center span is 400 m, while one-box girder is adopted as a bridge girder over the entire length.

On one hand, since the occupying ratio of the cable-stayed structure to the entire structure is large even in the cable-stayed suspension bridge, it is advantageous in the structure and the economy. However, it is hardly to say that such a bridge is a structure to be suitably applied to the long bridge having the length of the center span being 2000 m or more. For example, since the cable-stayed suspension bridge adopts the one-box girders as the bridge girder, the bridge girder in the central portion of the center span swings easily with crosswind. Therefore, it is difficult to raise a critical wind velocity at which fluttering begins to appear. Further, in case of the suspension structure in the central portion of the center span, the lower end portions of plural hanger ropes that extend downwardly from the main cables are connected to both sides in the transverse direction of the one-box girder. Therefore, the cable distance between the two main cables is large, so that the width of the top portion of the tower becomes larger, too and the tower becomes greater in size. Moreover, since the ratio of the length of the cable-stayed structure to the span length is large, the height of the tower is large for the span length, so that the towers become greater and the foundation structures for the towers become more bulky. Consequently, it is difficult to economically reduce the construction cost.

A first object of the present invention, which relates to a cable-stayed suspension bridge that adopts the cable-stayed structure and a suspension structure, is to increase the wind resistance of the bridge. A second object of the present invention is to attain the reduction in size of towers and foundation structures. A third object of the present invention is to reduce the diameter of main cables and attain the reduction in size of anchorage structures.

DISCLOSURE OF THE INVENTION

The cable-stayed suspension bridge using one-box and two-box girders in combination according to the present invention comprises a suspension bridge with plural towers and plural a bridge girder, wherein the bridge girder comprises one-box girders that each extend to both sides through the respective one tower and a two-box girder set in a central portion of the center span between the towers in the length direction of the bridge girder, the cable-stayed suspension bridge comprises cable-stayed structures in which a respective one of the one-box girders is supported by the tower with plural cables and a suspension structure in which the two-box girder is supported by the plural towers with the two main cables and the plural hanging ropes, and the opposite end portions in the transverse direction on an upper face of the two-box girder are provided with guide vanes for rectifying crosswind by passing it therethrough, and the opposite end portions in the transverse direction on the lower face of the two-box girder 11 is provided with guide vanes.

This cable-stayed suspension bridge using one-box and two-box girders in combination is provided with the one-box girders that each extend to the both sides through the respective one of the towers and the cable-stayed structures in which the one-box girder is supported by the tower with the plural cables. Since the one-box girder having a smaller width as compared with the two-box girder is supported by the cable-stayed structure, the width of the tower can be reduced, and the tower and its foundation structure can be reduced in size.

Since the two-box girder and the suspension structure where the two-box girder is hanged with two main cable and plural hanging ropes are adopted in the central portion of the center span in the longitudinal direction of the bridge girder, the wind resistance performance to the crosswind can be improved and the velocity of the wind at which fluttering begins to appear can be raised, by means of the two-box girder having an opening in the central portion in the transverse direction of the center span. When the two-box girder and the suspension structures are adopted over the entire length of the center span, the diameter of the main cables become larger, since the two-box girder is heavy. However, since the two-box girder and the suspension structure are employed only in the central portion of the center span, the diameter of the main cables can be reduced, the anchorage structure can be reduced in size, and the construction cost can be decreased.

When no guide vane is provided, the fluttering appearing limit wind velocity is raised only to around 60 m/s. On the other hand, since the cable-stayed suspension bride using the one-box and two-box girders in combination in this application is provided with the above guide vanes, the fluttering appearing limit wind velocity could be largely raised to around 90 m/s.

Here, the following construction may be employed in addition to the above-mentioned one.

(a) The above two-box girder has a central ventilation opening in the central portion as viewed in the transverse direction thereof. When crosswind acts, the wind flows through the central ventilation opening. Thus, the lift force to be generated in the two-box girder can be prevented from growing, so that the critical wind velocity at which fluttering begins to appear is raised, and the wind resistance stability of two-box girder can be improved.

(b) The cable distance between the above two main cables is set almost equal to the width of the central ventilation opening, the plural hanger ropes extend from the main cables almost perpendicularly, and the lower end portion of each hanger rope is connected to near the end portion in the transverse direction of the central ventilation opening in the two-box girder. Owing to this construction, the cable distance between the two main cables can be reduced, the width of the top portion of the tower where the two main cables are supported can be decreased, and the tower can be reduced in size to also decrease the size of the foundation structure.

(c) The lower end portions of the above plural cables are connected to near the end portions in the transverse direction of the one-box girder. Since a truss structure having an almost triangular shape as side view is constituted by the one-box girder and the plural cables connected to the opposite sides in the transverse direction of the one-box girder, the torsional rigidity of the bridge girder increases.

(d) Fairings for reducing wind load are provided at the end portions in the transverse direction of the two-box girder. The fairing may have a triangular shape in side view or a trapezoidal shape made convex sidewise.

(e) The span length of one-box girder is set almost equal to that of the two-box girder. If the span length of the one-box girder is extremely greater than that of the two-box girder, the ratio of the cable-stayed structure that occupies the entire structure rises, so that the height of the tower becomes larger, the foundation structure of the tower increases its size, and the diameter of the cables becomes larger. Thus, it is difficult to utilize the advantages of the cable-stayed structure. When the length of the one-box girder is set almost equal to that of the two-box girder, the cable-stayed suspension bridge that utilizes the advantages of the cable-stayed structure can be realized.

BRIEF DESCRIPTION OF THE DRAWINGS

FIG. 5 is an explanatory figure that shows main dimensions of the cable-stayed suspension bridge having undergone various analyses.

FIG. 6 is a diagram showing structural dimensions of the bridge girder in the cable-stayed suspension bridge of FIG. 5 and a suspension bridge as a comparative example.

FIG. 10 is a diagram showing vibration characteristics of the typical vibration mode obtained by the three-dimensional fluttering analysis concerning the fluttering characteristics of the above cable-stayed suspension bridge and the above suspension bridge.

BEST MODE OF THE INVENTION

Figure 1:
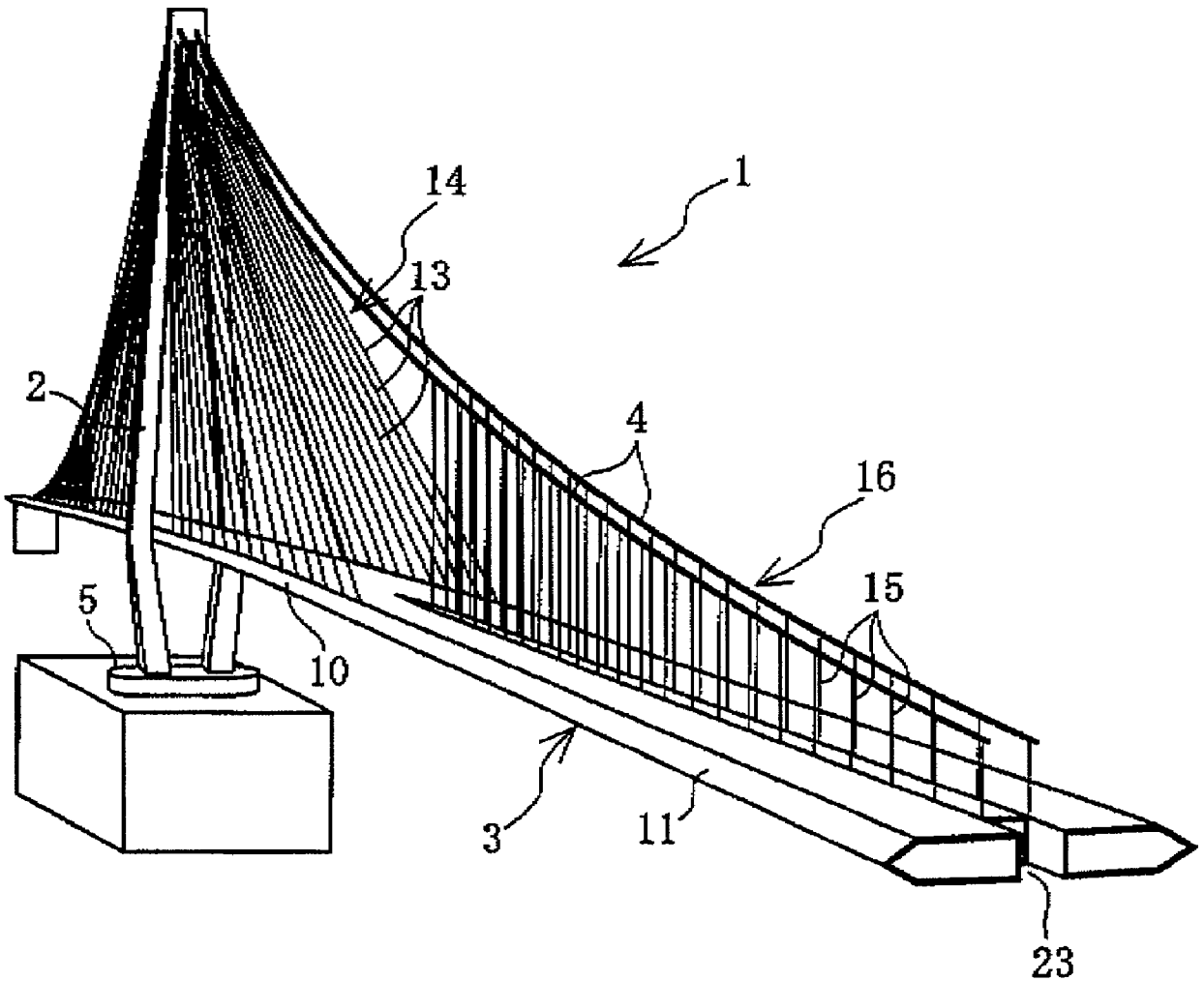
FIG. 1 is a perspective view of a principal portion of a cable stayed suspension bridge using one-box and two-box girders in combination according to one embodiment of the present invention.
Figure 2:
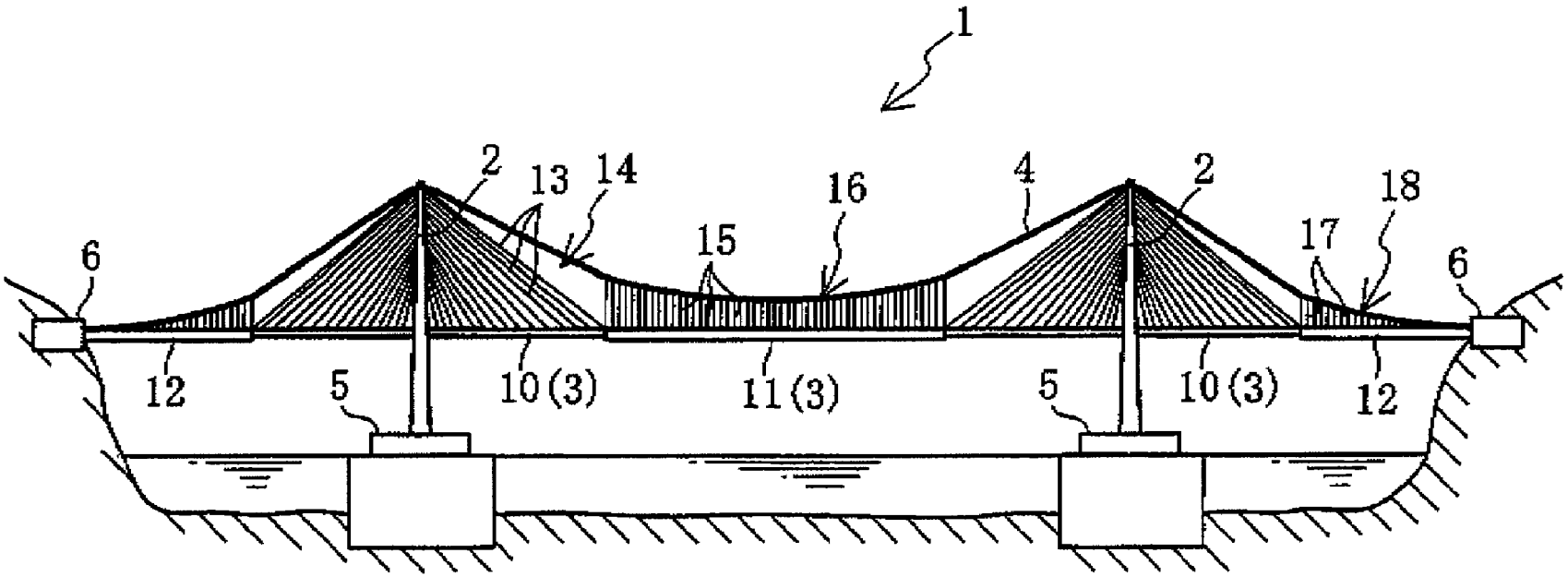
FIG. 2 is a side view of the above-mentioned cable-stayed suspension bridge.

The present invention relates to the cable stayed suspension bridge using one-box and two-box girders in combination. The best mode of the embodiments that carry out the present invention will be described on the basis of the drawings. FIG. 1 is a perspective view of a principal portion of the cable-stayed suspension bridge 1 using the one-box and two-box girders in combination (hereinafter, referred to as the cable-stayed suspension bridge) according to the present invention. FIG. 2 is a side view of this cable-stayed suspension bridge 1.

This cable-stayed suspension bridge 1 is a long bridge having 2500 m in length of the center span, and 1250 m in length of the side span, for instance. This cable-stayed suspension bridge 1 comprises two towers 2 set away from each other only by the length of the center span, a bridge girder 3 over the entire length, two main cables 4, two foundation structures 5 that support two towers 2, two anchorage structures 6 that fix the end portions of the two main cables 4 to ground, etc. The above bridge girder 3 comprises one-box girder 10 that extends to both sides through each tower 2, the first two-box girders 11 set in a central portion (a portion having about a half length of the center span) as viewed in the direction of the length of the bridge girder of the center span between the towers 2 and 2, and second two-box girders 12 set at a half portion of each of side spans near a bank, etc.

There are provided with cable-stayed structures 14 to support the above one-box girders 10 to the towers 2 with plural cables 13, a first suspension structure 16 to support the first two-box girder 11 to the two towers 2 by two main cables 4 and the plural hanger ropes 15, and a second suspension structures 18 to each support the two-box girder 12 with the two main cables 4 and the plural hanger ropes 17.

Dimensions of this cable-stayed suspension bridge 1 are given, for example, 2500 m in length of the center span, 1250 m in length of the side span, 1268 m in length of one-box girder 10, 1232 m in length of the first two-box girder 11, 616 m in length of the second two-box girders 12, and the cable distance between the main cables 4 being 7 m (Refer to FIG. 5). The above-mentioned dimensions are given by way of example, but the bridge is not limited to those dimensions. In this way, the length of one-box girder 10 and the first length of two-box girder 11 are set almost equally.

Figure 3:
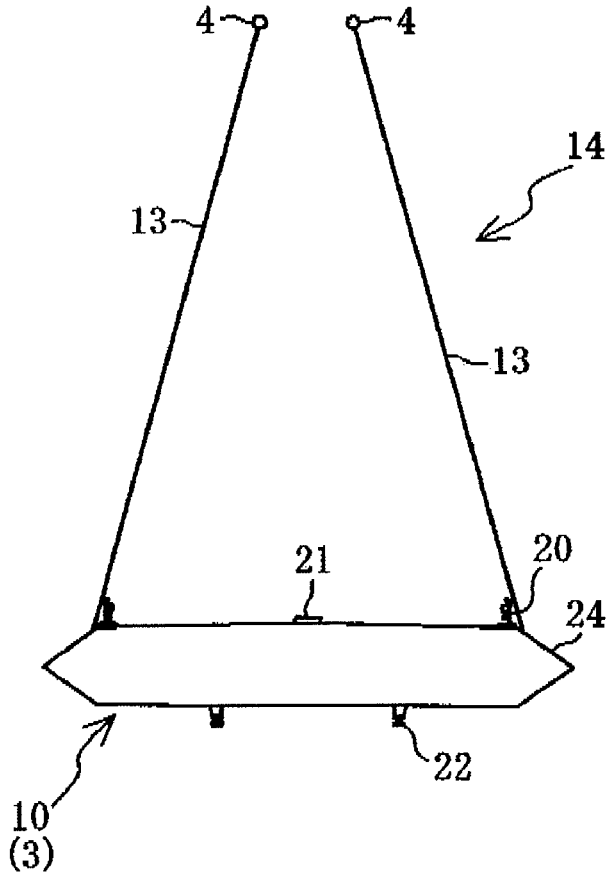
FIG. 3 is a sectional view of the one-box girder and a cable-stayed structure as viewed from a front side.
Figure 4:
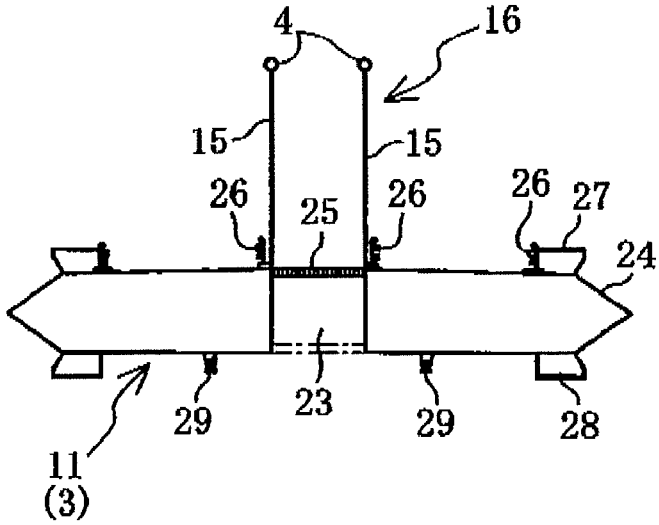
FIG. 4 is a sectional view of the two-box girder and a suspension structure as viewed from the front side.

As shown in FIG. 3, the one-box girder 10 is a steel structural flat type box girder as viewed in section, and its interior is hollow. Safety fences 20 (guardrails) are provide at opposite portions in the transverse direction of the one-box girder 10, and a center divider 21 is provided in the central portion as viewed in the transverse direction. Inspection car rails 22 may be provided at a lower face of the one-box girdle 10 to guide the inspection car at the time of maintenance after the cable-stayed suspension bridge 1 begins to be used. Plural cables 13 on both sides are set in such an inclined fashion that the interval in the lower portion increases. The lower end portions of plural cables 13 are connected with the edge portion of the portions as viewed in the transverse direction of the one-box girder 10 or the vicinity of the edge portion.

The first two-box girders 11 is a steel structural body in which two one box steel structural bodies each having a flat form as viewed in section are arranged in parallel and connected together, and its interior is hollow. The two-box girder 11 has a central ventilation opening 23 which is in the central portion as viewed in the transverse direction thereof and extends in the longitudinal direction of the two-box girder 11. The width of this central ventilation opening 23 is equally set as the distance between the cables. Plural hanger ropes 15 extend from the main cable 4 downward almost perpendicularly. The lower end portion of each of the hanger ropes 15 is connected with a transverse edge portion or its vicinity of the central ventilation opening 23 of the two-box girder 11 or the vicinity of the edge. It is desirable that the width of the central ventilation opening 23 is equal to the distance between the cables. However, it is sufficient that the width of the central ventilation opening 23 is roughly equal to the distance between the cables and that the hanger ropes 15 are almost perpendicularly arranged.

In this way, the plural hanger ropes 15 are perpendicularly arranged, and the lower end portions of the hanger ropes 15 are connected with the transverse edge portions or their vicinity of the central ventilation opening 23 of the two-box girder 11. The distance between the cables of the two main cables 4 can be set equally (or almost equal) to the width of central ventilation opening 23. Therefore, the width of the top part of the tower 2 is decreased, and the tower 2 and the foundation structure 5 can be reduced in size.

Fairings 24 for reducing a wind load are provided at edge portions in the transverse direction of one-box girder 10 and the first two-box girder 11. The fairing 24 has a triangular shape made convex laterally, but it is not limited to this shape. The shape may be a trapezoidal shape and hemicycle shape made convex laterally.

In the central ventilation opening 23 are provided plural connecting members (not shown), which connect the box-shaped structural bodies on both sides. An upper end portion of the central ventilation opening 23 may be provided with a grating structure 25 having excellent ventilation power, which serves as a passage for management. Safety fences 26 (guardrails) are provided at both transverse ends of the two-box girder 11 and both sides of the central ventilation opening 23. Moreover, the opposite end portions in the transverse direction of the two-box girder 11 are provided with the guide vanes 27 for rectifying crosswind by passing it therethrough, and the opposite end portions in the transverse direction of the lower face of the two-box girder 11 is provided with guide vanes 27, similarly to the above, for rectifying crosswind by passing it therethrough. Inspection car rail 29 may be provided at lower face of the two-box girder 11 as in the case of the one-box girder 10. Since the second two-box girder 12 and the suspension structure 18 that hangs the two-box girder 12 are almost the same as the first two-box girder 11 and its suspension structure 16, explanation thereof is omitted.

Next, the functions and the effects of the cable-stayed suspension bridge 1 described above will be explained. This cable-stayed suspension bridge 1 has the one-box girder 10 that extends over the both sides through a respective one of the towers and the cable-stayed structure 14 which supports the one-box girder 10 with plural cables 13. The width of tower 2 and that of foundation structure 5 of tower 2 can be decreased so that the cable-stayed structure 14 may support the one-box girder 10 having a smaller width as compared with the two-box girder.

Since that the longitudinally central portion of the center span of the bridge girder is provided with the hanging structure 16 which hangs the two-box girder 11 with the two main cables 4 and the plural hanger ropes 15, the two-box girders 11 having the central ventilation opening 23 in the transversely central portion can improve the aerodynamic to the crosswind and enhance a critical wind speed of coupled flutter.

Here, if the two-box girder 11 and the suspension structure 16 are adopted over the total length of the center span, the bridge girder becomes heavier and the diameter of the main cable 4 becomes greater. However, since the two-box girder 11 and the suspension structure 16 are employed only in the central portion of the center span, the diameter of the main cable 4 can be reduced, the anchorage structure 6 is reduced in size, and the cost of construction can be reduced. Since the two-box girder 11 has the central ventilation opening 23 in the transversely central portion, if the crosswind operates, the wind flows through the central ventilation opening 23. Therefore, the lift which would be generated in the bridge girder can be prevented from growing, and a flutter-appearing wind velocity can be raised, and the wind resistance stability of the cable-stayed suspension bridge 1 can be improved.

The cable distance between the two main cables 4 is set equal or almost equal to the width of the central ventilation opening 23. Plural hanger ropes 15 extend from the main cable 4 almost perpendicularly and the lower end of each of the hanger ropes 15 is connected to the edge in the transverse direction of the central ventilation opening 23 of the two-box girder 11 or the vicinity thereof. Thus, the cable distance between the two main cables 4 can be reduced, and the width of the top portion of the tower 2 where the two main cables 4 are supported can be reduced, and the tower 2 and the foundation structure 5 can be reduced in size.

The lower end portions of the plural cables 13 are connected with the edge portions in the transverse direction of the one-box girder 10 or the vicinity thereof. Therefore, since a triangular truss having an almost triangular shape as viewed from a front side is constituted by the plural cables 13 and the one-box girder 10. Consequently, the torsional rigidity of the bridge girder rises. Fairings 24 for reducing the wind load are provided at the edge portions in the transverse direction of the one box girder 10 and the two-box girders 11 and 12. Thus, by reducing the wind load acting upon the bridge girder can be suppressed. The horizontal displacements and the rotary displacements of the bridge girder that are caused by the crosswind can be controlled. When no guide vane is provided, the fluttering appearing limit wind velocity is raised only to around 60 m/s. On the other hand, since the cable-stayed suspension bride using the one-box and two-box girders in combination in this application is provided with the above guide vanes, the fluttering appearing limit wind velocity could be largely raised to around 90 m/s.

Since the length of one-box girder 10 is set almost equal to the length of two-box girder 11, the cable-stayed suspension bridge 1 that utilizes the advantages of the cable-stayed structure 14 can be achieved. If the one-box girder 10 is set extremely longer than the two-box girders 11, the ratio of the cable-stayed structures 14 that occupies the entire construction rises, the height of the tower 2 increases, the foundation structure 5 for the tower 2 becomes greater, and the diameter of the cable 13 becomes larger. Consequently, it is difficult to utilize the advantages of the cable-stayed structure 14.

Here, in case of the cable-stayed suspension bridge having the length of the center span longer than the above-mentioned value, the length of the first two-box girder 11 is changed longer, while the length of the one-box girder 10 is maintained to almost the same value as recited above. If the longitudinal length of the bridge girder of the cable-stayed structure 14 is too long, the tower 2 and the foundation structure 5 become larger, and the diameter of the cable 13 becomes greater. Thus, it becomes difficult to utilize the advantages of the cable-stayed structure 14.

Next, results in various simulation analyses performed by a computer on a cable-stayed suspension bridge 1 and a suspension bridge as a comparative example will be simply explained. The cable-stayed suspension bridge 1 that underwent the analyses was the same one as shown in the present embodiment, and main dimensions of the cable-stayed suspension bridge 1 and the suspension bridge as the comparative example are as shown in FIG. 5. The bridge girder in the suspension bridge of this comparative example (Hereinafter, referred to as the suspension bridge) is the same one as in the cable-stayed suspension bridge 1. FIG. 6 is a diagram that shows structural dimensions of the bridge girders (one-box girder and two-box girders) in the cable-stayed suspension bridge 1 and the suspension bridge that underwent the above-mentioned analyses.

Figure 7:
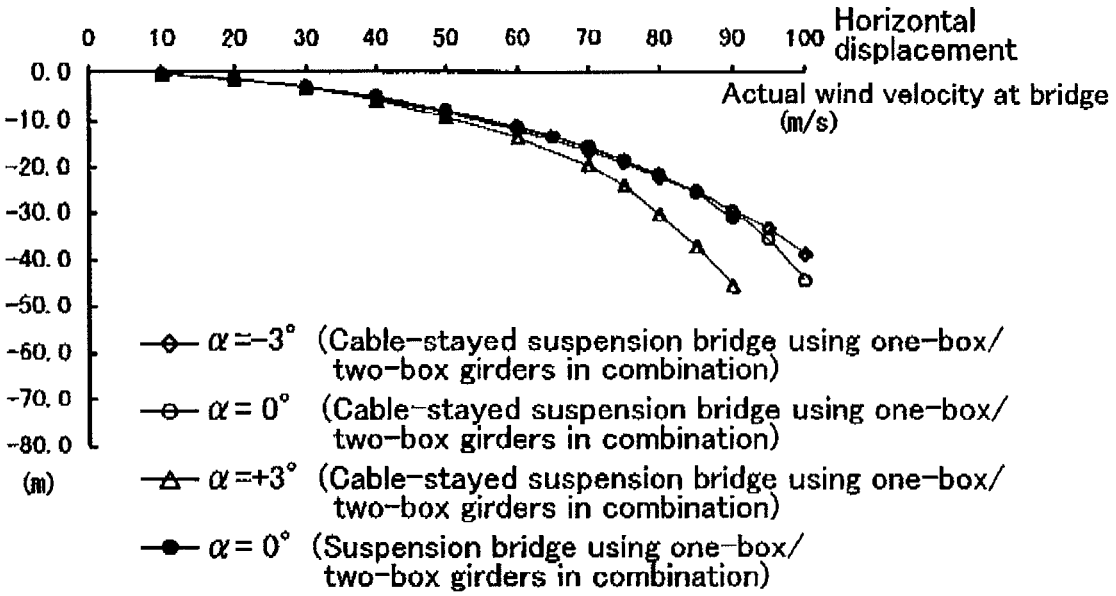
FIG. 7 is a graph showing horizontal displacements obtained by analysis of static deformations for crosswinds with respect to the cable-stayed suspension bridge and the suspension bridge (comparative example) as mentioned above.
Figure 8:
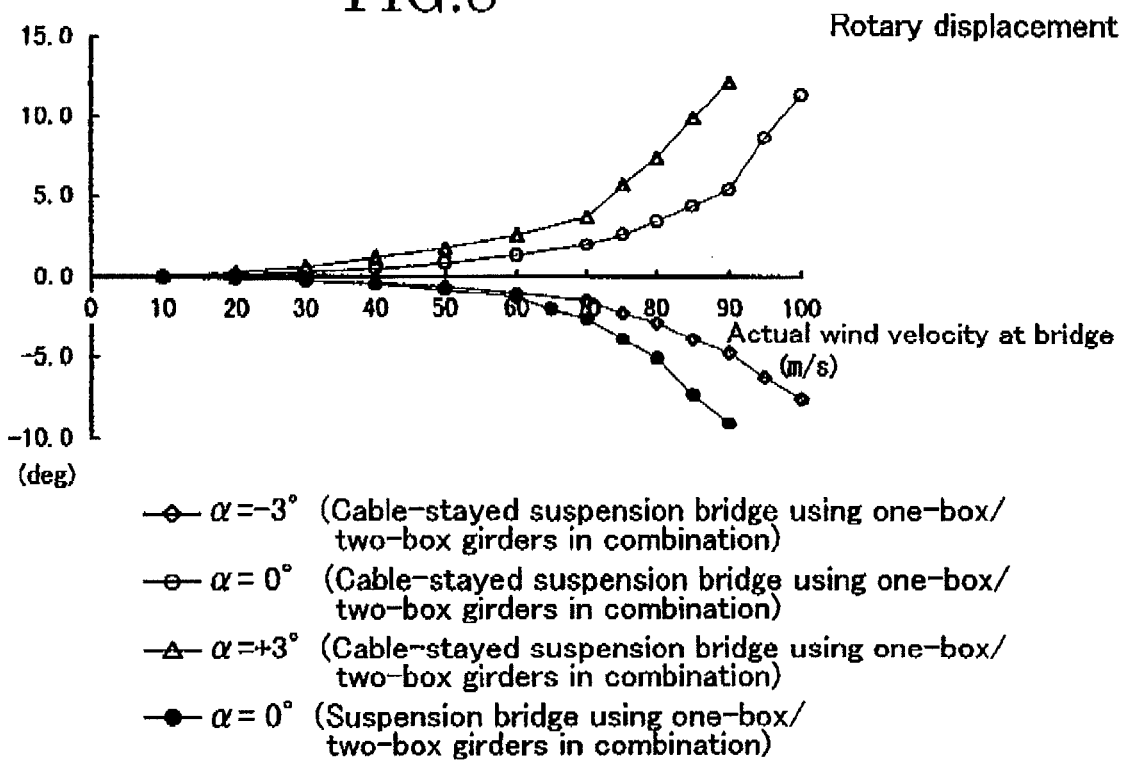
FIG. 8 is a graph showing rotary displacements obtained by the same static deformation analysis as mentioned above.
Figure 9:
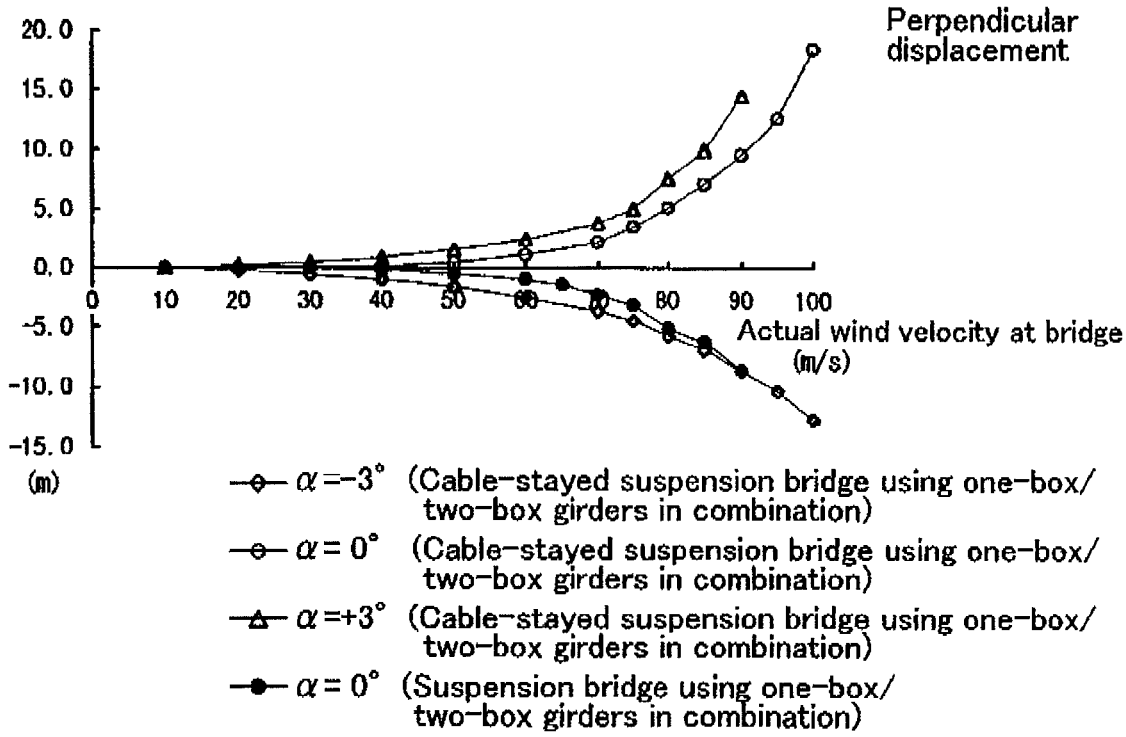
FIG. 9 is a graph showing perpendicular displacements obtained by the same static deformation analysis as mentioned above.

FIG. 7 to FIG. 9 show results of the static deformation analysis performed on the above cable-stayed suspension bridge and the above suspension bridge. With respect to the cable-stayed suspension bridge, the analyses were performed, while inclination degrees from the horizontal plane of the crosswind were set to three angles: −3°, 0°, and +3°. With respect to the suspension bridge, the analyses were performed, while inclination degree of the crosswind was set to 0°. FIG. 7 shows the horizontal displacements generated in the central portion of the center span. Similar tendency was shown in the horizontal displacements of the cable-stayed suspension bridge 1 and those of the suspension bridge, both of them are within the tolerable range. FIG. 8 shows rotary displacements (twisted displacements) generated in the central portion of the center span. In case of the crosswind of an angle of 0° to the grinder, the suspension bridge turns such that the windward side is inclined downwardly, while the cable-stayed suspension bridge turns such that the windward side is inclined upwardly. It is considered that since a restraint action is applied upon the cable-stayed suspension bridge 1 by the cables 13 of the cable-stayed structure 14, such a rotation characteristic (twisted characteristic) appears. However, there is the possibility that the rotary displacements can be largely reduced by adjusting the torsional rigidity, etc. of the cable-stayed structure 14. The above rotary displacements are within the tolerable range, too.

FIG. 9 shows perpendicular displacements generated in the central portion of the center span. These displacements show the same tendency as in the characteristic of FIG. 8. Similarly to the rotary displacements, there is the possibility that the perpendicular displacements can be largely reduced by adjusting the torsional rigidity, etc. of the cable-stayed structure 14. The above perpendicular displacements are within the tolerable range, too.

FIG. 10 is a diagram that shows vibration characteristics of a typical vibration mode obtained by the three-dimensional fluttering analysis (from a low-level to the 50th vibration modes) of the fluttering characteristics regarding the cable-stayed suspension bridge 1 and the suspension bridge. The cable-stayed suspension bridge 1 and the suspension bridge show roughly similar vibration characteristics. Typical vibration modes of the cable-stayed suspension bridge 1 were the 2nd, 8th, and 22nd vibration modes.

Figure 11:
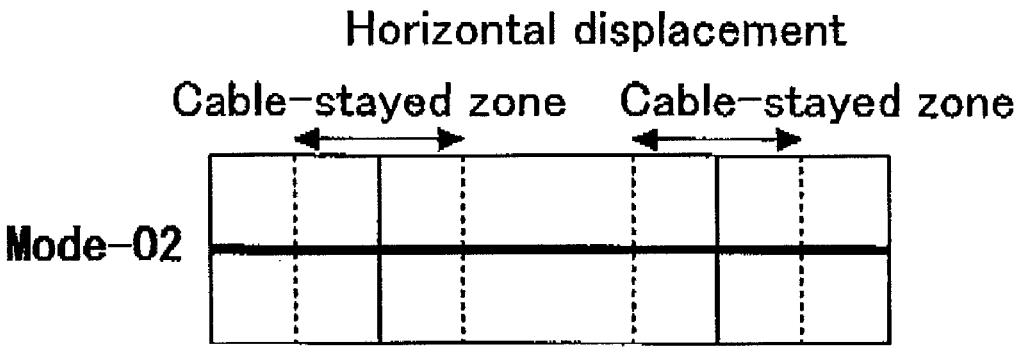
FIG. 11 is a characteristic figure of horizontal displacements in case of a typical vibration mode (second vibration mode) of the cable-stayed suspension bridge obtained by the above three-dimensional fluttering analysis.
Figure 12:
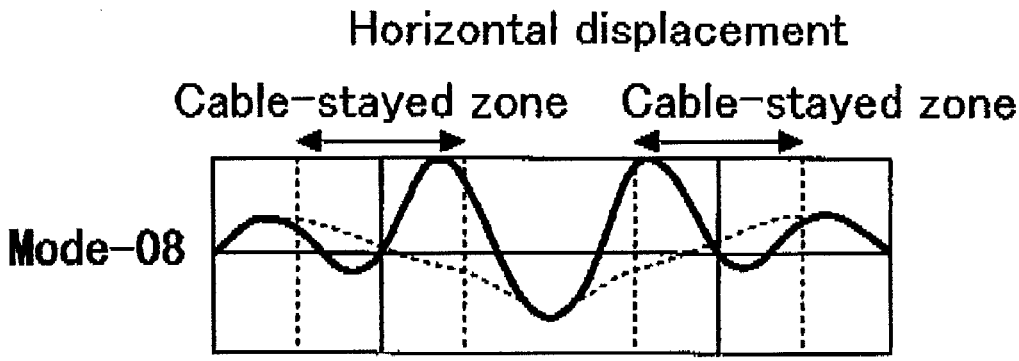
FIG. 12 is a characteristic figure of horizontal displacements at a typical vibration mode (eighth vibration mode) of the cable-stayed suspension bridge obtained by the above three-dimensional fluttering analysis.
Figure 13:
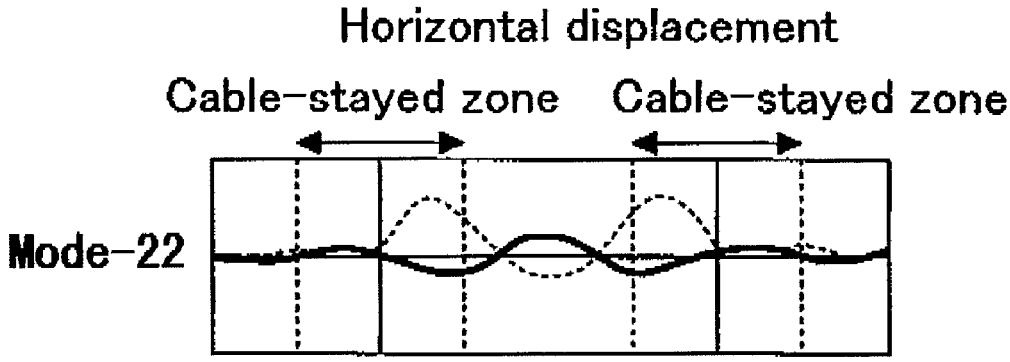
FIG. 13 is a characteristic figure of horizontal displacements at a typical vibration mode (22nd vibration mode) of the cable-stayed suspension bridge obtained by the above three-dimensional fluttering analysis.
Figure 14:
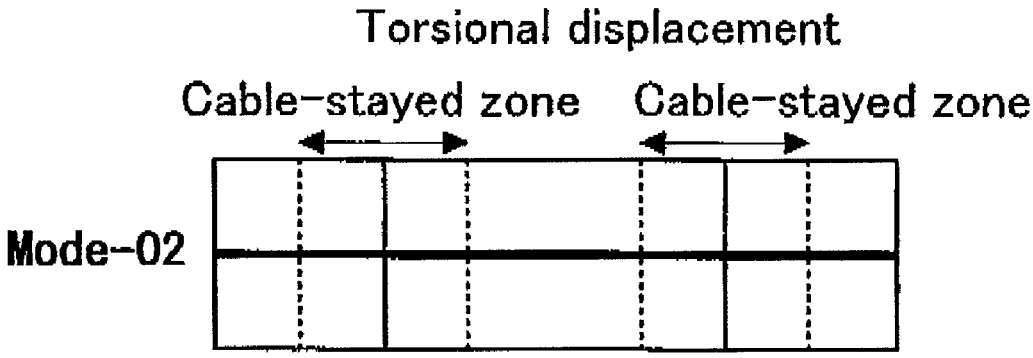
FIG. 14 is a characteristic figure of torsional displacements at a typical vibration mode (second vibration mode) of the cable-stayed suspension bridge obtained by the above three-dimensional fluttering analysis.
Figure 15:
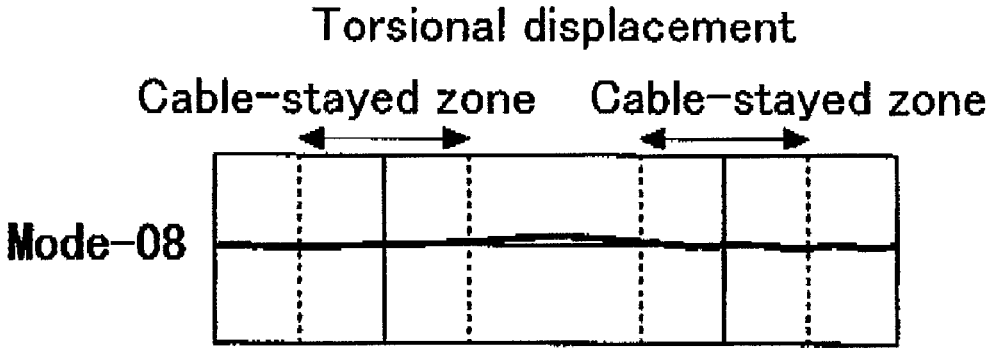
FIG. 15 is a characteristic figure of torsional displacements at a typical vibration mode (eighth vibration mode) of the cable-stayed suspension bridge obtained by the above three-dimensional fluttering analysis.
Figure 16:
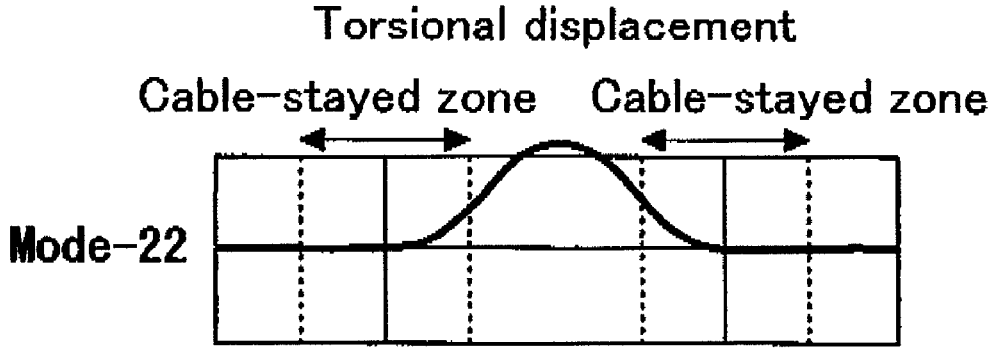
FIG. 16 is a characteristic figure of torsional displacements at a typical vibration mode (22nd vibration mode) of the cable-stayed suspension bridge obtained by the above three-dimensional fluttering analysis.
Figure 17:
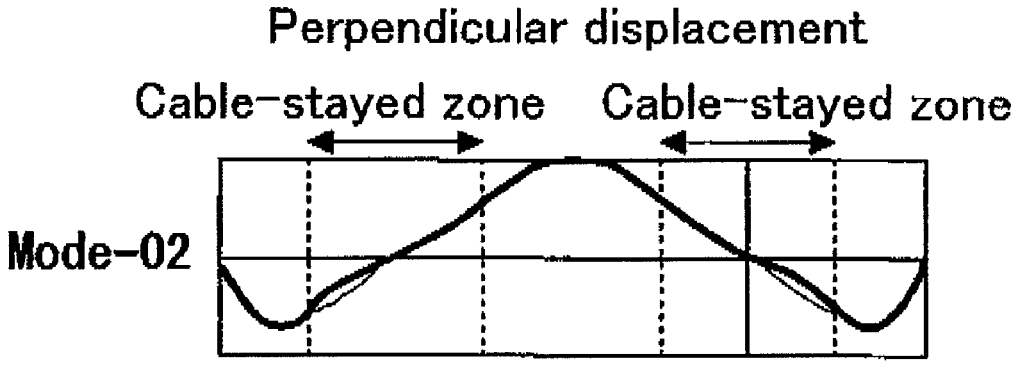
FIG. 17 is a characteristic figure of perpendicular displacements at a typical vibration mode (second vibration mode) of the cable-stayed suspension bridge obtained by the above three-dimensional fluttering analysis.
Figure 18:
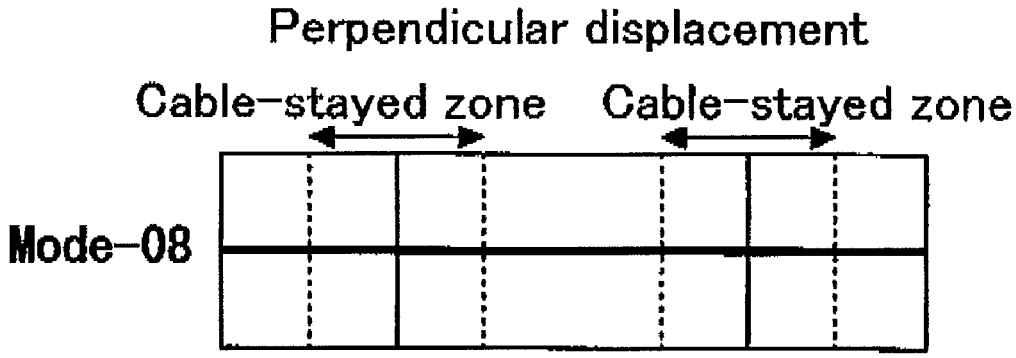
FIG. 18 is a characteristic figure of perpendicular displacements at a typical vibration mode (eighth vibration mode) of the cable-stayed suspension bridge obtained by the above three-dimensional fluttering analysis.
Figure 19:
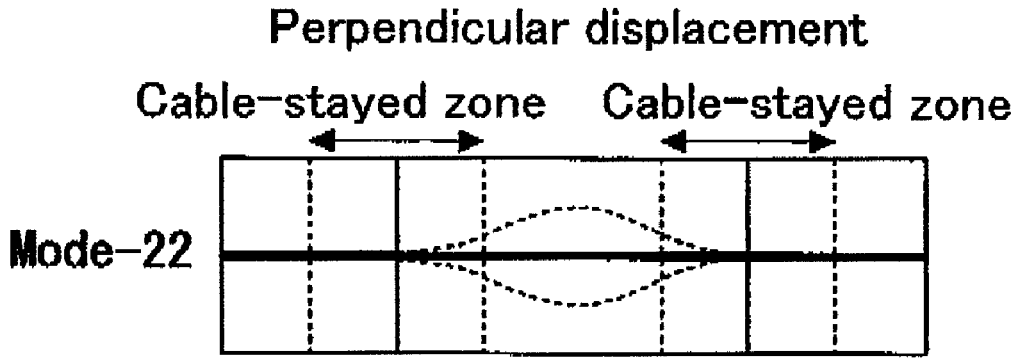
FIG. 19 is a characteristic figure of perpendicular displacements at a typical vibration mode (22nd vibration mode) of the cable-stayed suspension bridge obtained by the above three-dimensional fluttering analysis.

FIG. 11 to FIG. 19 show the 2nd, 8th and 22nd vibration characteristics concerning the cable-stayed suspension bridge 1. FIG. 11 to FIG. 13 show the vibration characteristics concerning the horizontal displacements. FIG. 14 to FIG. 16 show the vibration characteristics concerning torsional displacements. FIG. 17 to FIG. 19 show the vibration characteristics concerning the perpendicular displacements.

Figure 20:
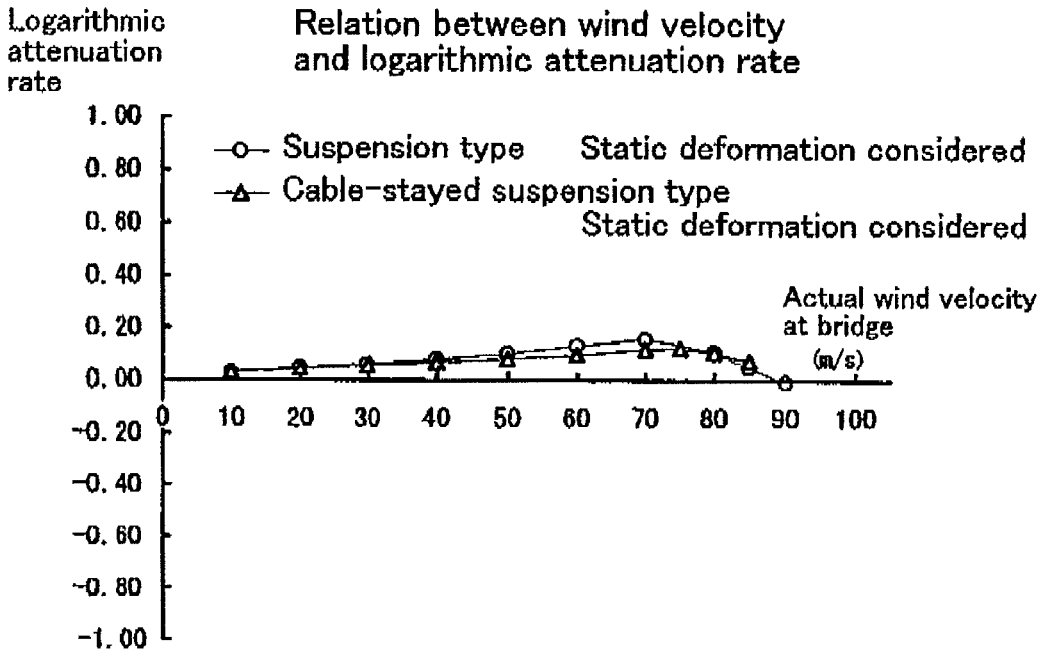
FIG. 20 is a graph showing the relation between the velocity of wind and the logarithmic attenuation rate obtained by the fluttering analysis with respect to the cable-stayed suspension bridge and the suspension bridge (comparative example).
Figure 21:
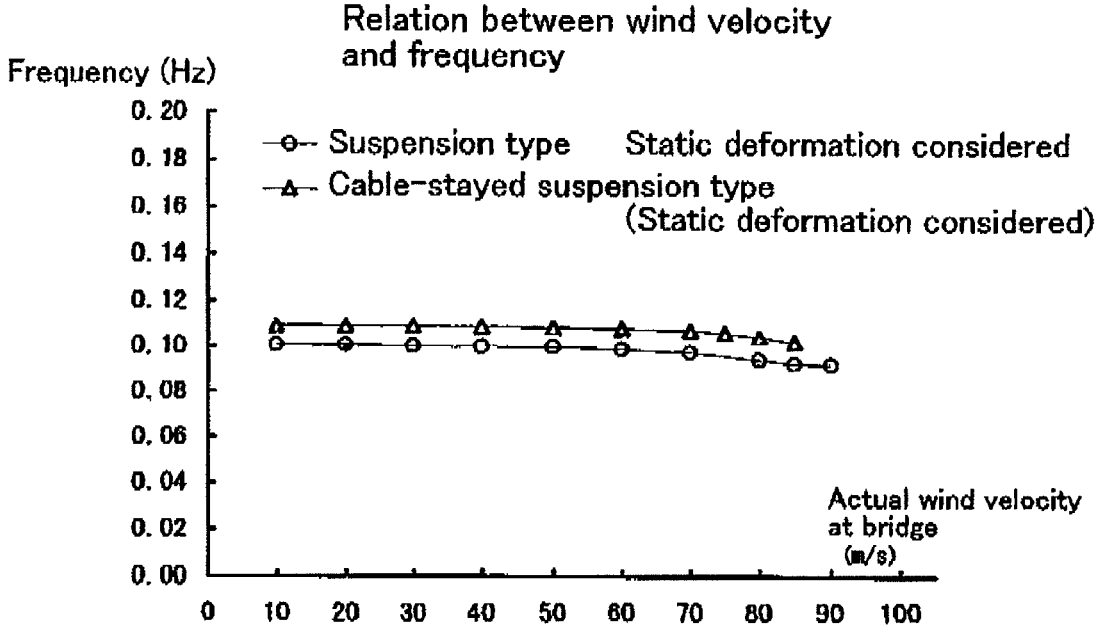
FIG. 21 is a graph showing the relation between the velocity of wind and the frequency of vibration obtained by the fluttering analysis.

FIG. 20 is a graph showing the relation between the wind velocity and the logarithmic attenuation rate obtained by the fluttering analysis performed on the cable-stayed suspension bridge 1 and the suspension bridge. The cable-stayed suspension bridge 1 and the suspension bridge showed roughly similar attenuation characteristics. The attenuation rate which can reduce fluttering is taken as "positive characteristic". Cable-stayed suspension bridge 1 actually constructed are required to withstand the wind velocity of around 80 m/s. It is understood from the logarithmic attenuation rate shown in FIG. 20 that this cable-stayed suspension bridge 1 can sufficiently endure the wind velocity of around 80 m/s. FIG. 21 is a graph showing the relation between the wind velocity and the vibration frequency obtained by the above fluttering analysis. The cable-stayed suspension bridge 1 and the suspension bridge show roughly similar vibration frequencies.

Here, partially modified examples of the above cable stayed suspension bridge 1 using the one-box and the two-box girders in combination according to the above-mentioned embodiment will be described.

1) In the above-mentioned embodiment, the cable-stayed suspension bridge 1 using the one-box and two-box girders in combination that had two towers 2, and had one center span was explained by way of example. However, the present invention can be also similarly applied to the cable stayed suspension bridge making combined use of one-box girders and two-box girders with three or more towers 2 and two or more center spans.

2) The ratio between the width of the central ventilation opening 23 in the central portion of the two-box girder 11 and the width of two-box girder 11 is not limited to the one in the above-mentioned embodiment. The width of the central ventilation opening 23 may be made further greater or smaller. It is preferable to set the hanger ropes 15 in the suspension structure 16 in a perpendicular posture, but they may be set in a posture inclined slightly from the perpendicular posture.

3) Guide vanes similar to those in the two-box girder 11 are provided at both end portions of the upper face of the one-box girder 10. Further, guide vanes may be provided at both end portions of the lower face of the one-box girder 10.

What is claimed is:

1. A cable-stayed suspension bridge using one-box and two-box girders in combination comprising a suspension bridge with plural towers and a bridge girder, wherein the bridge girder includes one-box girders that extend to both sides of each tower and a two-box girder set provided in a central portion of a center span between the towers in a length direction of the bridge girder, wherein the cable-stayed suspension bridge includes cable-stayed structures in which a respective one of the one-box girders is supported by the tower with plural cables and a suspension structure in which the two-box girder is supported by the plural towers with two main cables and plural hanging ropes, wherein opposite end portions in a transverse direction on an upper face of the two-box girder are provided with guide vanes for rectifying crosswind by passing the crosswind and opposite end portions in the transverse direction on a lower face of the two-box girder is provided with guide vanes, wherein the two-box girder has a central ventilation opening in the central portion as viewed in a transverse direction thereof, and wherein the cable distance between the two main cables is substantially equal to the width of the central ventilation opening, the plural hanging ropes extend from the main cables substantially perpendicularly to the two-box girder, and the lower end portion of each hanging rope is connected to near the end portion in the transverse direction of the central ventilation opening in the two-box girder.

2. The cable-stayed suspension bridge set forth in claim 1, wherein the lower end portions of the plural cables are connected to near the end portions in the transverse direction of the one-box girder.

3. The cable-stayed suspension bridge set forth in claim 1, wherein fairings for reducing wind load are provided at the end portions in the transverse direction of the two-box girder.

4. The cable-stayed suspension bridge set forth in claim 1, wherein the length of one-box girder is set almost equal to that of the two-box girder.

* * * * *